US011918067B2

(12) United States Patent
Rhode

(10) Patent No.: US 11,918,067 B2
(45) Date of Patent: Mar. 5, 2024

(54) GARMENT AND SHIRT STAY DEVICE

(71) Applicant: ACUMEN APPAREL, LLC, Ponte Vedra Beach, FL (US)

(72) Inventor: Bryan Rhode, Ponte Vedra Beach, FL (US)

(73) Assignee: Acumen Apparel, LLC, Ponte Vedra Beach, FL (US)

( * ) Notice: Subject to any disclaimer, the term of this patent is extended or adjusted under 35 U.S.C. 154(b) by 37 days.

(21) Appl. No.: 17/325,130

(22) Filed: May 19, 2021

(65) Prior Publication Data

US 2022/0061439 A1 Mar. 3, 2022

Related U.S. Application Data

(60) Provisional application No. 63/071,225, filed on Aug. 27, 2020.

(51) Int. Cl.
*A41F 17/00* (2006.01)
*A41B 11/12* (2006.01)

(52) U.S. Cl.
CPC ..... *A41F 17/00* (2013.01); *A41B 11/12* (2013.01)

(58) Field of Classification Search
CPC ..... A41F 17/00; A41F 11/00; A41F 11/02; A41F 11/14; A41F 11/16; A41F 11/18; A41F 13/00; A41F 19/00; A41B 1/06; A41B 11/12; A41B 11/125
See application file for complete search history.

(56) References Cited

U.S. PATENT DOCUMENTS 739,766 A * 9/1903 White ..... A41F 11/02 24/537
775,422 A * 11/1904 Higley ..... A41F 11/02 2/306
915,228 A * 3/1909 Seiffert ..... A41F 11/02 2/335
1,016,354 A * 2/1912 Munich ..... A41B 11/12 2/240
1,087,726 A * 2/1914 Carty ..... A41B 11/12 2/240
1,119,930 A * 12/1914 Decker ..... A41B 11/12 2/240
1,310,084 A * 7/1919 Jones ..... A41F 11/14 2/315
1,330,794 A * 2/1920 Furey ..... A41F 11/02 24/480
1,333,417 A * 3/1920 Hilemon ..... A41F 11/02 24/480
1,377,031 A * 5/1921 Monroe ..... A41F 11/14 2/315

(Continued)

*Primary Examiner* — Heather Mangine
(74) *Attorney, Agent, or Firm* — Dentons Cohen & Grigsby P.C.

(57) ABSTRACT

A shirt stay device and system useful for biasing a shirt to it's tucked in position. The system includes a shirt having connectors attached to the hem at the left and right sides, a pair of socks having an attachment loop attached to an outer side of a top opening thereof, and a set of two shirt stay devices that provide connection between the shirt hem and the socks. The length of each shirt stay device is adjustable to apply a tension between the shirt hem and the socks, and thus bias the shirt to a tucked in position.

12 Claims, 9 Drawing Sheets

(56) References Cited

U.S. PATENT DOCUMENTS 1,402,594 A * 1/1922 Gedney ..... A41F 11/02 24/559
1,407,200 A * 2/1922 Kelly ..... A41F 11/02 2/325
1,437,123 A * 11/1922 Wiechmann ..... A41B 11/12 2/240
1,438,354 A * 12/1922 Bain ..... A41F 11/02 24/493
1,451,191 A * 4/1923 Wade ..... A41F 11/02 604/401
1,464,380 A * 8/1923 Agee ..... A41F 11/02 2/335
1,525,454 A * 2/1925 Llufrio ..... A41F 11/02 24/519
1,538,098 A * 5/1925 Duffy ..... A41F 11/14 450/111
1,621,153 A * 3/1927 Bunnenberg ..... A41B 11/12 2/242
1,823,736 A * 9/1931 Goodman ..... A41B 11/125 2/240
1,859,097 A * 5/1932 Kayser ..... A41F 11/02 2/315
1,965,314 A * 7/1934 Henderson ..... A41B 11/12 450/111
2,083,885 A * 6/1937 Wheeler ..... A41F 11/02 24/570
2,117,286 A * 5/1938 Bliesath ..... A41F 11/16 24/519
2,342,974 A * 2/1944 Sepessy ..... A41B 11/12 2/240
2,500,506 A * 3/1950 Avary ..... A41F 11/02 2/314
2,508,049 A * 5/1950 Tuck ..... A41F 11/02 2/229
2,567,277 A * 9/1951 Farquhar ..... A41F 11/02 2/315
2,779,026 A * 1/1957 Rosecrans, Sr. ..... A41F 11/16 2/312
2,805,424 A * 9/1957 Johnson, Jr. ..... A41B 11/12 2/240
2,895,480 A * 7/1959 Fixel ..... A41F 17/00 450/111
3,602,012 A * 8/1971 Burleson ..... D04B 1/106 66/172 R
4,187,619 A * 2/1980 Gibbs ..... A43B 23/28 D2/980
4,597,109 A * 7/1986 Hironaga ..... A41F 17/00 2/117
5,027,441 A * 7/1991 Wilson ..... A41F 11/00 2/241
5,345,613 A * 9/1994 Jones ..... A41F 11/00 2/303
6,247,183 B1 * 6/2001 Haas-Laursen ..... A41F 13/00 2/239
D573,918 S * 7/2008 Tustin ..... D11/5
7,891,023 B1 * 2/2011 Hill ..... A41F 3/00 2/310
9,049,895 B1 * 6/2015 Wesol ..... A41F 11/18
9,788,976 B1 * 10/2017 Thompson ..... A61F 2/78
9,913,505 B1 * 3/2018 Wilson ..... A41F 17/00
11,350,676 B1 * 6/2022 Law ..... A41F 17/00
2002/0112275 A1 * 8/2002 Hall ..... A41F 19/00 2/310
2009/0235432 A1 * 9/2009 Crittenden ..... A41F 17/04 2/232
2011/0099686 A1 * 5/2011 Carter ..... A41F 17/00 2/117
2011/0191942 A1 * 8/2011 Villalobos ..... A41B 11/00 2/240
2012/0060262 A1 * 3/2012 Herman ..... A41F 3/00 2/326
2012/0137417 A1 * 6/2012 Pease ..... A41D 13/0007 2/463
2012/0309264 A1 * 12/2012 Kubik ..... A41C 3/04 450/86
2013/0247280 A1 * 9/2013 Haggard ..... A41F 11/14 2/256
2014/0173804 A1 * 6/2014 Matos ..... A45F 5/06 24/3.12
2014/0215690 A1 * 8/2014 Caulfield ..... A41F 17/00 2/227
2015/0135395 A1 * 5/2015 Galil ..... A41F 17/00 2/340
2016/0007666 A1 * 1/2016 Pagcaliwagan ..... A41F 17/00 2/313
2016/0235148 A1 * 8/2016 Tadysak ..... A43B 23/00
2016/0338436 A1 * 11/2016 Horrey ..... A41F 17/02
2019/0000165 A1 * 1/2019 Reed ..... A41F 1/06
2021/0186122 A1 * 6/2021 Price ..... A41B 11/04
2021/0219665 A1 * 7/2021 Ferrantello ..... A41F 11/00
2022/0061439 A1 * 3/2022 Rhode ..... A41F 17/00

* cited by examiner

GARMENT AND SHIRT STAY DEVICE

CROSS REFERENCE TO RELATED APPLICATIONS

This application claims priority to U.S. Provisional Patent Application No. 63/071,225 filed Aug. 27, 2020, the entire content of which is incorporated herein by reference.

FIELD OF INVENTION

This disclosure generally relates to a clothing accessory that biases a shirttail to a flat and fully extended position, systems that include the accessory and associated garments, and methods of using the same.

BACKGROUND

A smooth, tucked in shirt is a staple of many professional workplaces and organizational uniforms, including for military personnel, private schools, and business and other professional offices. Shirt stays are used to hold a wearer's shirt in place and are generally made of an elastic strap that connects the bottom of the wearer's shirt to the wearer's socks or as a stirrup around the wearer's foot. Traditional shirt stays are usually constructed from an elongated elastic band with two or more ends that connect to the wearer's shirt and sock or shirt and foot. Attachment to the shirt and/or sock is generally via a clip, such as a garter clip or alligator clip, which may damage the clothing and can be difficult to attach and detach. Examples of such devices are disclosed in each of U.S. Pat. Nos. 300,924; 1,412,033; 1,464,380; 1,570,492; 1,859,097; 2,608,692; 2,733,448; 9,049,895; and 9,339,071.

Certain prior art disclosures have endeavored to provide systems that are easier to attach and/or detach. One such system is disclosed in U.S. Pat. Application Publication No. 2013/0247280, which includes a strap having a disconnect in the middle thereof. While such a system makes for quick disconnect of two halves of the strap, the portions connected to the shirt and socks remain attached, wherein the portion attached to the shirt hem in particular still includes an alligator style clip, a configuration that may cause damage to the garment. U.S. Pat. No. 8,291,515 discloses a system that includes holes positioned in the lower hem region of a shirt, wherein the holes provide attachment of a garter clip. While this system obviates some of the possible damage caused to the shirt by previous prior art systems, it still yet requires use of a garter clip, and does not solve the complications of using such connection systems for attachment to the wearer's socks.

BRIEF SUMMARY

The presently disclosed invention solves many of the complications of these prior art systems, providing a shirt stay device attachable to each of a shirt and a sock via integrated attachment means. The shirt stay device generally comprises an elongated portion of material having connectors at each end thereof, wherein the connectors are configured for attachment to mated connectors on the shirt and socks. In this way, the user may quickly connect or disconnect the shirt stay device without damaging the shirt or socks.

Accordingly, the present disclosure provides a shirt stay device comprising an elongated length of material; a male or female component of a side release buckle attached to the elongated length of material at a first end of the shirt stay device and configured for connection with a female or male component, respectively, positioned adjacent to a hem of a shirt, such as above the hem of the shirt; a hook attached to the elongated length of material at a second end of the shirt stay device and configured for connection with a loop on a top opening of a sock; and an adjustable suspender attached on the elongated length of material and configured to adjust a length of the shirt stay device to release or apply a tension between the hem of the shirt and the sock.

The present disclosure also provides a system for biasing a shirt to a tucked in position, the system comprising a shirt having a first side release buckle component affixed to a left hem of the shirt, and a second side release buckle component affixed to a right hem of the shirt; a first shirt stay device; a second shirt stay device; a first sock component; and a second sock component. First ends of the first and second shirt stay devices are configured to releasably attach to the first and second side release buckle components of the shirt, and second ends of the first and second shirt stay devices are configured to releasably attach to the first and second sock components. Moreover, a length of each of the first and second shirt stay devices is adjustable to apply a tension between the shirt and the first and second sock components.

The present disclosure also provides a shirt stay system comprising a shirt comprising a right-side connector attached to a right hem of the shirt, and a left-side connector attached to a left hem of the shirt, each above a hem of the shirt; a pair of socks, each sock of the pair comprising an attachment loop attached to an outer side of a top opening thereof; and a set of two shirt stay devices. Each shirt stay device comprises an elongated length of material, a shirt connection component attached to the elongated length of material at a first end thereof and configured for releasable connection with either of the right-side or left-side connectors of the shirt component, a hook attached to the elongated length of material at a second end thereof and configured for connection with the attachment loop of either sock of the pair of socks, and an adjustable suspender attached on the elongated length of material and configured to adjust a length of the shirt stay device. The length of each of the shirt stay devices is adjustable to apply a tension between the shirt component and the first and second sock components.

In each system, the sock may comprise an attachment loop affixed to an outer side of a top opening thereof. The attachment loop may comprise a D-ring or O-ring attached to the outer side of the top opening of the sock by a length of material. The length of material may be permanently affixed to the top opening of the sock and may releasably or non-releasably connect the D-ring or O-ring thereto. Alternatively, the attachment loop may be a fabric loop.

Moreover, the first and second side release buckle components of the shirt may be affixed to an internal or external hem of the shirt, such as by a loop of material. The loop of material may be permanently affixed to the hem of the shirt and may releasably or non-releasably connect the first and second side release buckles thereto.

The present disclosure further yet provides a method of using the shirt stay systems disclosed herein to bias a wearer's shirt to the tucked in position. The method generally comprises, in any order, (a) mating the shirt connection component of a first shirt stay device to either of the right-side or the left-side connector on the shirt, (b) mating the shirt connection component of a second shirt stay device to the other of the right-side or the left-side connector on the shirt, (c) connecting the hook of the first shirt stay device to an attachment loop of a first sock, (d) connecting the hook of the second shirt stay device to an attachment loop of a second sock of the pair of socks, and (e) adjusting the length of the first shirt stay device and the second shirt stay device to accommodate the user's height and to apply a tension between the shirt and the first and second socks.

DESCRIPTION OF THE DRAWINGS

The present invention described herein may be better understood by reference to the accompanying drawing sheets, in which.

DETAILED DESCRIPTION

Figure 1:
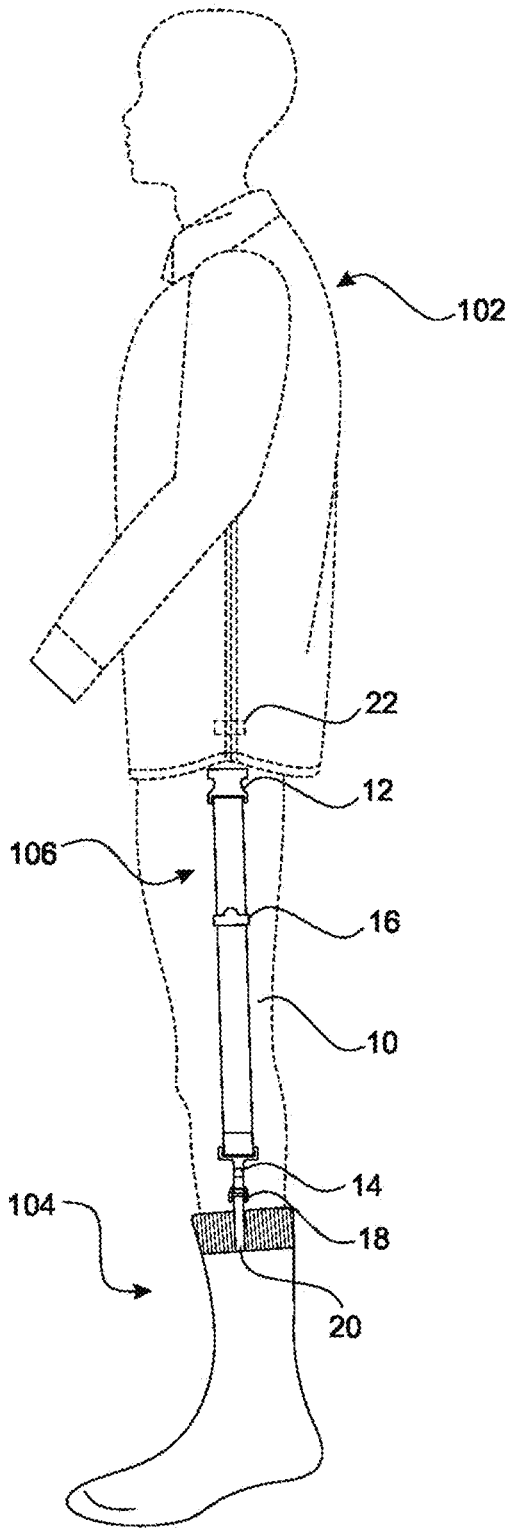
FIG. 1 illustrates a side view of a men's dress shirt and socks with connected shirt stay device in accordance with aspects of the presently disclosed invention.

In the following description, the present invention is set forth in the context of various alternative embodiments and implementations involving shirt stay devices and systems that include the shirt stay devices. The embodiments disclosed herein provide a more robust means for biasing a wearer's shirt to a tucked in position, and make it easier for the wearer to attach/detach the shirt stay device to/from their garments, such as to their shirt and socks.

Various aspects of the shirt stay device and system comprising the shirt stay device may be illustrated by describing components that are coupled, attached, and/or joined together. As used herein, the terms "coupled", "attached", and/or "joined" are interchangeably used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements shown in said examples.

Various aspects of the systems, methods, and devices disclosed herein may be illustrated with reference to one or more exemplary implementations. As used herein, the term "exemplary" means "serving as an example, instance, or illustration," and should not necessarily be construed as preferred or advantageous over other variations of the systems or methods disclosed herein. "Optional" or "optionally" means that the subsequently described event or circumstance may or may not occur, and that the description includes instances where the event occurs and instances where it does not.

Furthermore, throughout the specification, reference to "one embodiment," "an embodiment," or "some embodiments" means that a particular described feature, structure, or characteristic is included in at least one embodiment. Thus, appearances of the phrases "in one embodiment," "in an embodiment," or "in some embodiments" in various places throughout this specification are not necessarily all referring to the same embodiment. Those skilled in the art will recognize that the various embodiments can be practiced without one or more of the specific details or with other methods, components, materials, etc. In other instances, well-known structures, materials, or operations are not shown or not described in detail to avoid obscuring aspects of the embodiments.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the various parts of the needle or any assembly of them may be used.

It must also be noted that as used herein and in the appended claims, the singular forms "a", "an", and "the" include the plural reference unless the context clearly dictates otherwise. Thus, for example, reference to "a" sock, "an" elastomeric material, or "the" shirt, is a reference to one or more of each and equivalents thereof known to those skilled in the art, and so forth. Unless defined otherwise, all technical and scientific terms used herein have the same meanings as commonly understood by one of ordinary skill in the art.

"Substantially the same", as used herein, is understood to mean that two values or measurements are within 30% of each other, such as within 20% of each other, or within 10% of each other, or even within 5% of each other. Where it is indicated that two values are the same as each other is understood to mean that two values or measurements deviate from one another by less than 5%, or even less than 2%.

All numerical quantities stated herein are approximate, unless indicated otherwise, and are to be understood as being prefaced and modified in all instances by the term "about". The numerical quantities disclosed herein are to be understood as not being strictly limited to the exact numerical values recited. Instead, unless indicated otherwise, each numerical value included in this disclosure is intended to mean both the recited value and a functionally equivalent range surrounding that value.

All numerical ranges recited herein include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value equal to or less than 10.

As generally used herein, the terms "include", "includes", and "including" are meant to be non-limiting. As generally used herein, the terms "have", "has", and "having" are meant to be non-limiting.

The presently disclosed invention relates generally to a shirt stay device, and a system comprising the shirt stay device. The system may include a shirt, i.e., garment intended to cover an upper torso of a wearer, a pair of socks, and a pair of shirt stay devices configured to provide connection between each of the socks and the shirt. The presently disclosed invention also relates generally to unique shirt and sock designs that incorporate attachment means, providing attachment of the shirt stay device thereto. The various components of the system may be provided separately, or as a system including each of a shirt, two shirt stay devices, and a pair of socks. For example, a user may purchase a system that includes a shirt, two shirt stay devices, and a pair of socks, and several extra pairs of socks and/or shirts, as the shirt stay devices may not require laundering as frequently as the shirt and/or socks.

A non-limiting exemplary embodiment of the present disclosure is shown in FIGS. 1-11. As shown in FIG. 1, a shirt stay system may include a shirt stay device 106 that may be used to connect a wearer's garment 102, e.g., shirt, to their socks 104, thus biasing the shirt to a tucked in position, such as inside the wearer's pants, shorts, or skirt.

Figure 11:
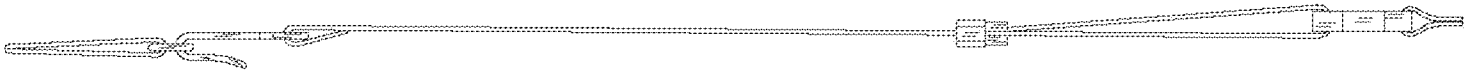
FIG. 11 illustrates a left or right-side view of the shirt stay device of the system shown in FIG. 6.

With reference to FIGS. 1 and 11, front and side views, respectively, of a shirt stay device 106 generally comprising an elongated portion of material 10 are shown. The elongated portion of material 10 may be formed of an elongated length of a textile or fabric. According to various aspects, the textile may comprise a stretchable material, such as an elastic or elastomeric material (e.g., elastane, materials comprising synthetic or natural rubber, etc.). The elongated portion of material 10 may have a length of between 25 cm and 150 cm. The elongated portion of material may have a width of between 1 cm and 10 cm.

The elongated portion of material 10 may be adjustable via an adjustable suspender 16 to apply a tension between the garment 102 and the socks 104. The adjustable suspender 16 may be slidably mated to the elongated portion of material 10 to lengthen or shorten the shirt stay device. In this way, the elongated portion of material 10 may be adjusted to accommodate a plurality of shirt lengths and sock heights, and users of various heights.

The adjustable suspender 16 may comprise metal or plastic portions. The adjustable suspender 16 may include teeth for engaging sides of the elongated portion of material 10, which may be disengaged from the side thereof and moved upward or downward to lengthen or shorten the shirt stay device. For example, as shown in FIG. 11, moving the adjustable suspender 16 upward toward the garment 102 may lengthen the shirt stay device, or downward toward the socks 104 may shorten the shirt stay device. Alternatively, the adjustable suspender 16 could be positioned such that the loop of the elongated length of material (10) is adjacent the end of the shirt stay device nearest the sock, in which case an opposite motion would be used to lengthen or shorten the shirt stay device. Once properly positioned, the teeth may be reengaged with the side of the elongated length of material 10.

Other types and designs of adjustable suspenders are available, such as a buckle through which the material 10 passes twice (formed as a squared off FIG. 8), so that a tension of the material passing through the buckle maintains the buckle's position on the material once set. As above, movement of the buckle may shorten or lengthen the shirt stay device.

The adjustable suspender 16 may have a width that is substantially the same as or slightly larger than a width of the elongated length of material 10. According to aspects, the adjustable suspender 16 may have a width of 1 cm to 10 cm, such as 2 cm to 4 cm, or even about 2.5 cm.

When in use on a shirt or other garment, the shirt stay device 106 may lie parallel with and against the wearer's leg, as shown in FIG. 1. The shirt stay device 106 may comprise an attachment means at each end thereof, such as a connector 12 at a proximal end configured for attachment to a hem region of a garment 102, such as a men's dress shirt as shown, and an attachment device 14 at a distal end configured for attachment to a top portion of a sock 104. The attachment position 22 of the connector 12 to the garment 102 is shown as stitching on the outside hem region of the shirt.

Figures 2A, 2B:
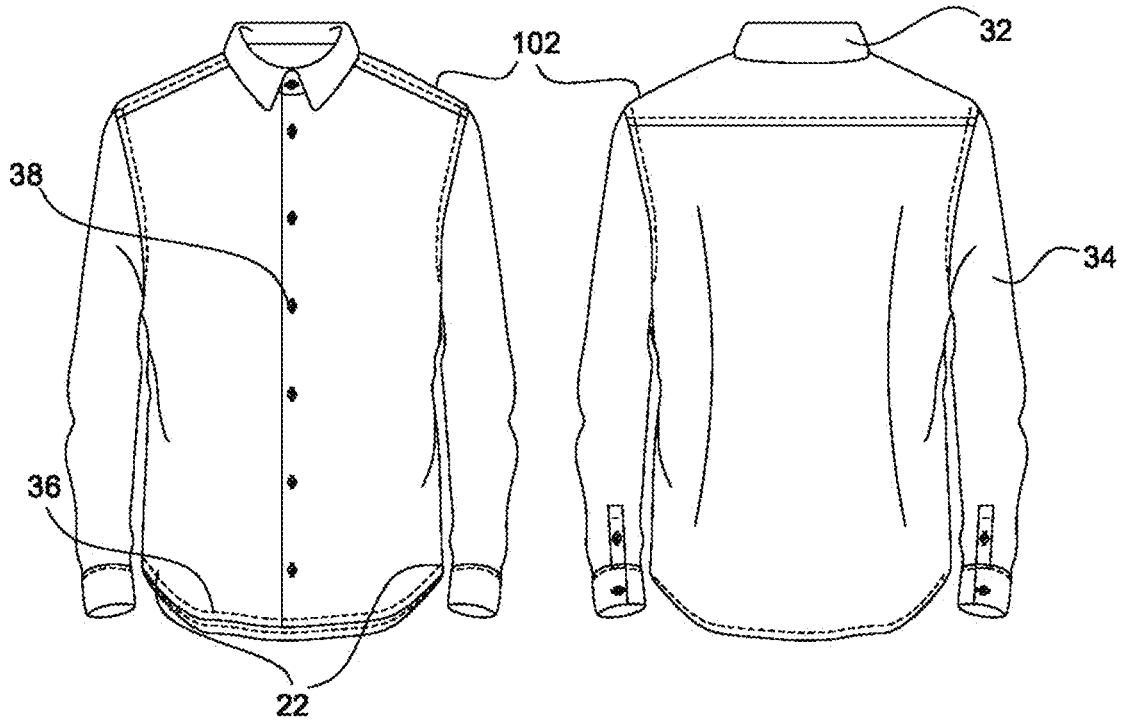
FIGS. 2A and 2B illustrates front and back views of a shirt component comprising a connector for a shirt stay device in accordance with aspects of the presently disclosed invention.

As illustrated in the figures, such as in FIGS. 2A and 2B, an exemplary embodiment of the presently disclosed system for biasing a shirttail to the tucked position within a waistband includes a garment 102 having a hem or shirt tail 36, buttons 38, long sleeves 34, and a collar 32. It is understood by those of ordinary skill that the shirttail is a bottom portion of a garment worn on an upper torso, such as a shirt, blouse, tunic, tee shirt, and other similar garment. Moreover, as shown in FIG. 2A, the first and second components of the attachment means affixed to the garment may be positioned (22) equidistant from the center of the garment.

Each of these garments may have no sleeves, short sleeves, or long sleeves. The waistband may be on a skirt, shorts, pants, trousers, or other similar outer garments work on a lower torso and trunk. The garment may comprise a fabric material. The fabric material may comprise silk, rayon, nylon, wool, cotton, linen, acetate, acrylic, LYCRA®, polyester, spandex, jersey, or any other fabric or textile known in the art for forming garments. In one exemplary embodiment, the garment is a dress shirt made from silk, cotton, linen, polyester, rayon, or blends thereof.

Figure 3:
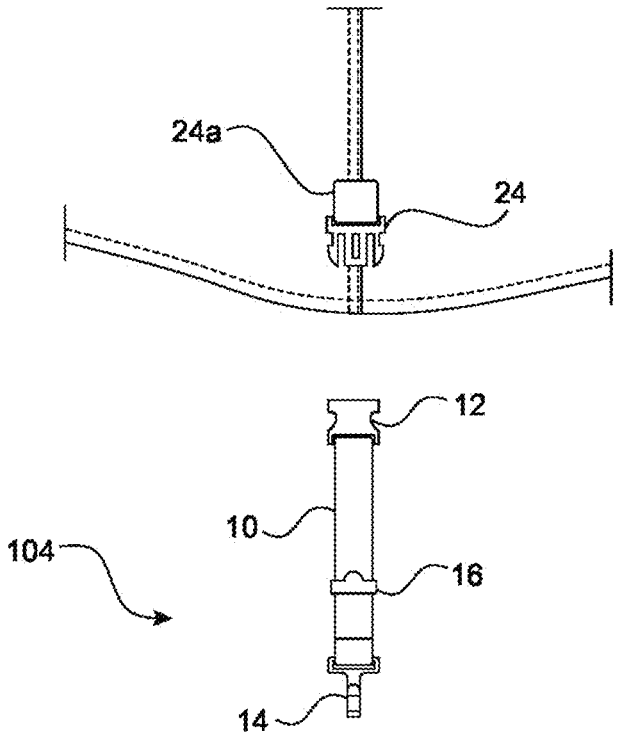
FIG. 3 illustrates a close-up view a connector on an inner side of a shirt and a shirt stay device disconnected therefrom in accordance with aspects of the presently disclosed invention.
Figure 9:
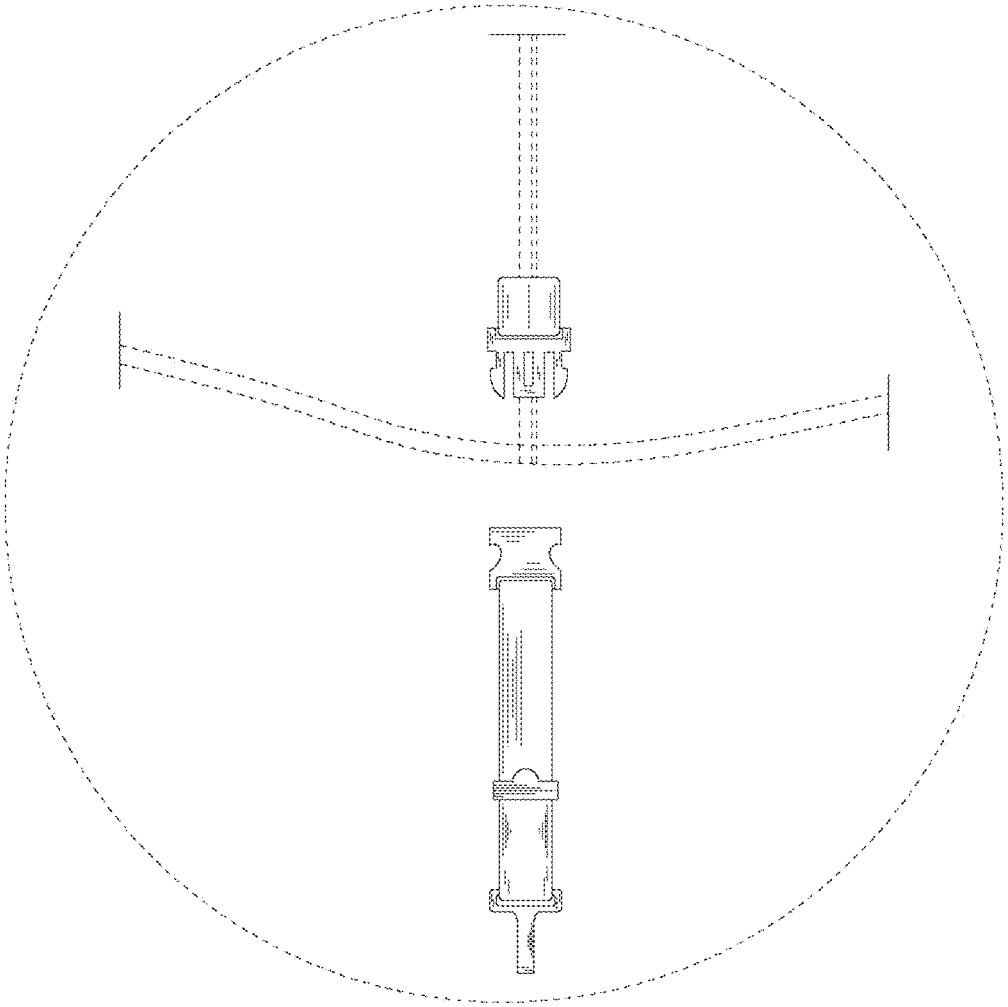
FIG. 9 illustrates a close-up view of the shirt stay system shown in FIG. 6, showing an inner side of the shirt with the shirt stay device disconnected therefrom.

With reference to FIG. 3, the connector 12 at the proximal end of the shirt stay device 106 may comprise a male or female component of a side release buckle configured to releasably attach to the garment. The garment connector 24 of the garment may comprise the corresponding component of the side release buckle. For example, as shown in FIGS. 3 and 9, the connector 12 at the proximal end of the shirt stay device comprises a female component of the side release buckle and the garment connector 24 on the hem of the garment comprises a male component of the side release buckle.

It is understood by those of ordinary skill that the side release buckle comprises releasably connectable male and female components. The male component of the buckle typically includes a pair of resilient arms that may be inserted and releasably locked in the female component to couple other components. Side-release buckles include recesses at the sides of the female component that expose the arms of the male component such that the male and female components may be uncoupled by pressing the arms of the male component at the side recesses to disengage the components. The side release buckle may be made of plastic material. The female component of the side release buckle may have a width of 1 cm to 10 cm, such as 1 cm to 5 cm, such as 2 cm to 4 cm, such as about 2.5 cm.

The garment connector 24 of the garment 102 may be permanently (i.e., non-releasably) or releasably attached to an inside hem of the shirt, as shown in FIG. 3, or to an outside hem of the shirt. Moreover, the garment connector 24 may be attached to a side portion of the garment 102, such as along a side seam of the garment. For example, the garment connector 24 may be attached to the garment 102 by a length of material 24*a* that passes through a slot in the garment connector 24, wherein at least one end of the length of material 24*a* is stitched or otherwise permanently attached to the garment 102. A second end of the length of material 24*a* may also be stitched or otherwise permanently attached to the garment, such that the garment connector 24 is not removeable.

In an exemplary embodiment, the garment connector 24 may be attached to the garment 102 via a double needle stitched reinforced fabric loop (length of material 24*a*) on the interior or exterior seam of the garment. According to aspects, the length of material 24*a* may be affixed about 3-5 cm from a bottom hem of the garment 102. As such, the garment connector 24 may be positioned on an internal or external side of the garment 102 above the bottom hem, such as above the bottom hem of the side seam.

Alternatively, the second end of the length of material 24*a* may be releasably connected to the garment 102, such as by a snap, hook and loop closure (e.g., VELCRO®), button, or the like. In this configuration, one end of the length of material 24*a* may be opened to provide releasable attachment of the garment connector 24 such that it can be removed for repair, replacement, etc.

Figure 4:
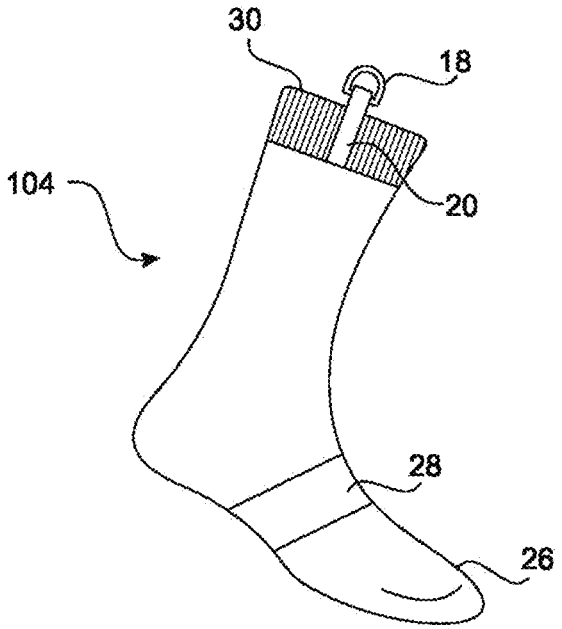
FIG. 4 illustrates a side view of a sock component comprising a connector for a shirt stay device in accordance with aspects of the presently disclosed invention.
Figure 5:
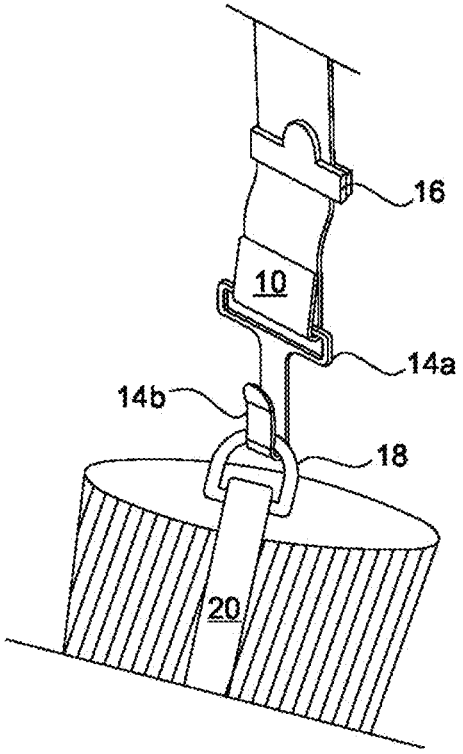
FIG. 5 illustrates a close-up view of the shirt stay device connected to the sock component in accordance with aspects of the presently disclosed invention.

With reference to FIGS. 4 and 5, an exemplary embodiment of the presently disclosed system for biasing a shirttail to the tucked position within a waistband includes a sock 104 having a top opening 30 opposite a heel region, and a toe region 26 extending therefrom. The sock may include any length between the heel region and the top opening, e.g., may be a mid-length calf height sock or a knee height sock. The sock may compress a ball of the foot portion, an arch of the foot portion, and/or a heel and ankle of the foot portion. The sock may include compression material 28 around an arch region of a foot portion, thus providing compression of the user's foot in the arch region. The compressive material may be one of nylon, polyester, spandex, or cotton.

Figure 10:
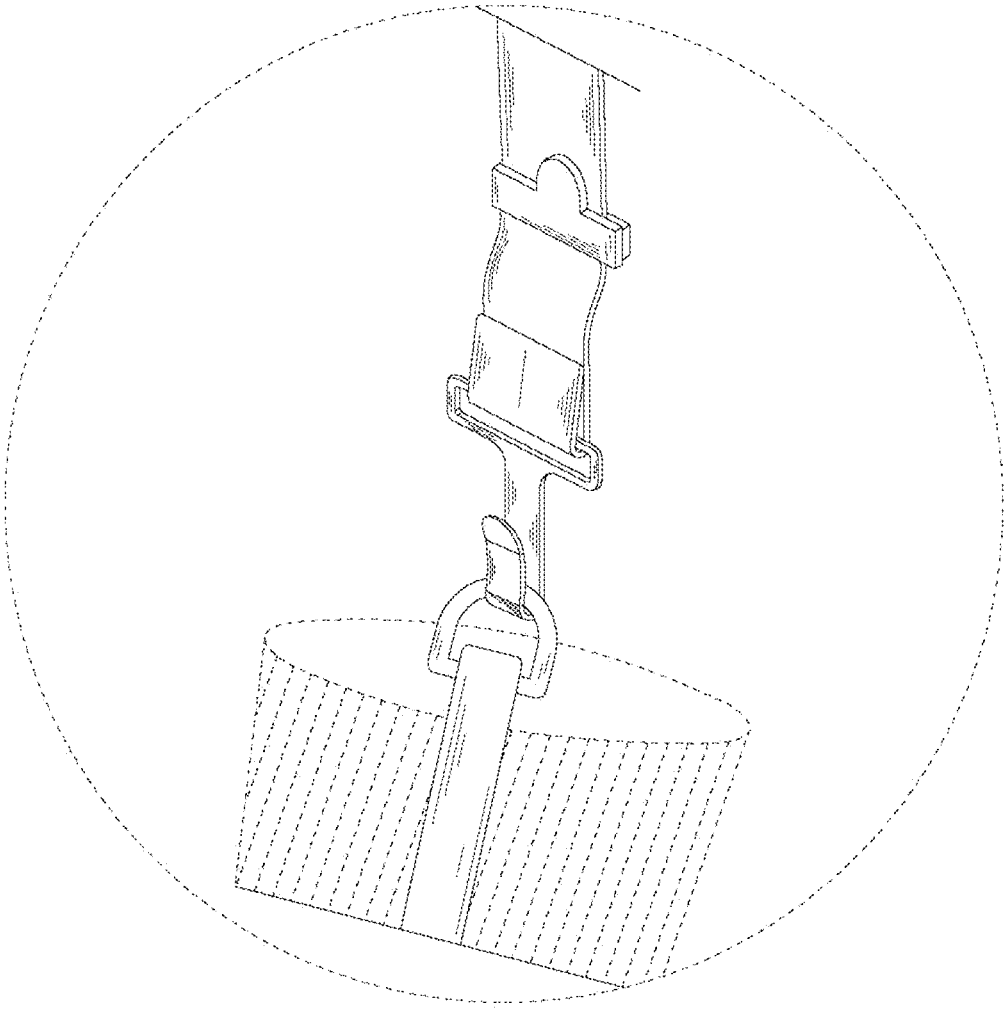
FIG. 10 illustrates a close-up view of the shirt stay system shown in FIG. 6, showing the shirt stay device connected to the sock.

The sock 104 may include a loop 18 that provides attachment for the attachment device 14 at the distal end of the shirt stay device 106. As shown in FIGS. 5 and 10, the attachment device 14 may comprise a hook 14*b* attached or attachable to a distal end of the elongated length of material 10 via a slot 14*a*. The hook 14*b* is connectable to the loop 18 of the sock 104. The loop 18 of the sock may be a D-ring, as shown in FIG. 5, or an O-ring, or a loop of fabric or textile material. Alternatively, the attachment device 14 could be connected directly with the top looped end of the length of material 20.

Thus, in a non-limiting exemplary embodiment, the first and/or second sock component has an attachment loop affixed to an edge of the top opening 30, wherein the attachment loop is a metal or plastic D-ring. In a preferred embodiment, the loop 18 is a D-ring with a base of about 1 cm to 4 cm, such as 2 cm to 3 cm, or even about 23.5 mm, and a height of about 0.5 cm to 2 cm, or about 0.5 cm to 1.5 cm, or even about 10 mm. In another non-limiting exemplary embodiment, the loop 18 is an O ring with a width of about 0.5 cm to 2 cm, or about 0.5 cm to 1.5 cm, or even about 10 mm. In another non-limiting exemplary embodiment, the attachment loop is a fabric loop (e.g., same as 20, or a fabric loop 18) with a width of about 0.5 cm to 2 cm, or about 0.5 cm to 1.5 cm, or even about 10 mm.

According to aspects, the hook 14*b* that connects to the loop 18 may have a length of 0.5 cm to 4 cm, such as 1 cm to 3 cm, or about 2 cm. While shown as a simple hook, other attachment devices at the distal end of the shirt stay device 106 are possible and within the scope of the present invention. For example, the attachment device 14 may include a snap that would be connectable to a corresponding snap on the sock, or a hook having a closure mechanism, such as a self-closing hook, etc.

With continued reference to FIG. 5, the loop 18 may be attached to the sock via a length of material 20. The length of material 20 may be permanently affixed to the sock, such as along an inner and outer side of a top opening 30 of the sock. In such a configuration, the loop 18 may be permanently attached to the sock. Alternatively, the length of material 20 may be affixed to the sock along a first end region, and may include a releasable connection to the sock along a second end region, such as via a snap, hook and loop closure (i.e., VELCRO®), a button, or the like. In this configuration, one end of the length of material 20 may be opened to provide releasable attachment of the loop 18 such that it can be removed for repair, replacement, etc. Moreover, while the loop 18 and length of material 20 are shown to be positioned on the outer side of the sock 104, such as along an outside of the wearer legs when worn, other positions are possible and within the scope of the present disclosure (e.g., positioned forward toward the front of the wearer's leg or backward toward the back of the wearer's leg, etc.).

Figure 6:
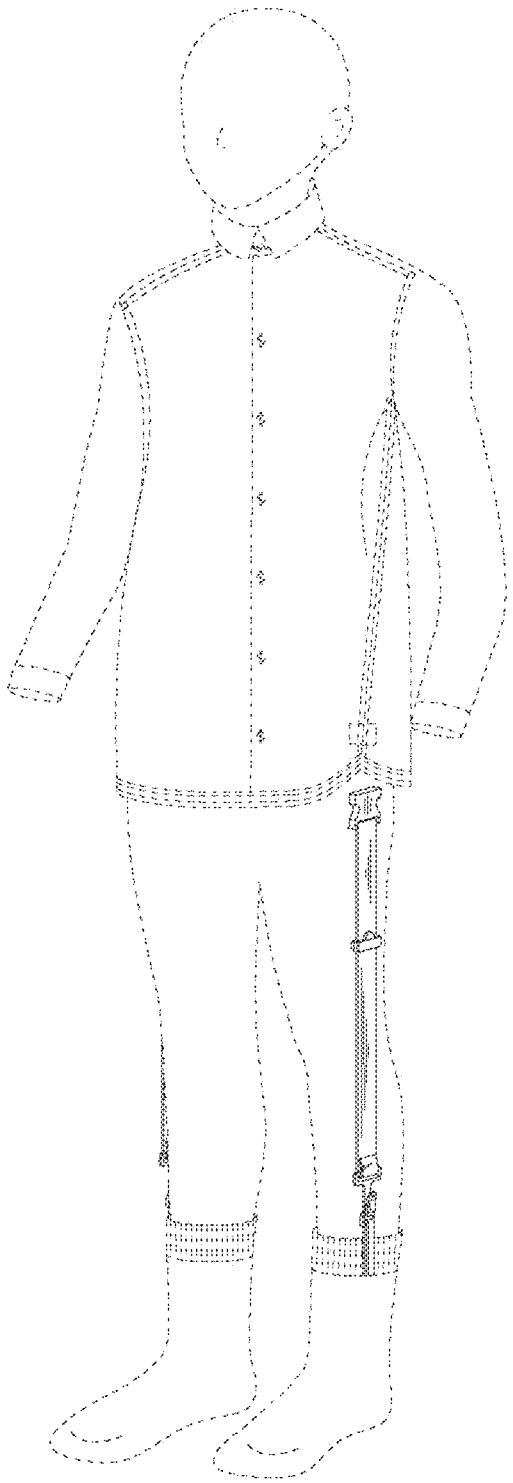
FIG. 6 illustrates a perspective view of a person using the shirt stay system in accordance with aspects of the presently disclosed invention, wherein a shirt stay device is shown connected to an outer opening of each sock on the wearer's feet and disconnected from the shirt.

With reference to FIG. 6, a first component of an attachment means may be affixed to a first side of the garment and may be connected to a first connection means on a first sock by a first shirt stay device. A second component of an attachment means may be affixed to a second side of the shirt and may be connected to a second connection means on a second sock by a second shirt stay device.

A method of using a garment and shirt stay device for biasing a shirttail to a flat and fully extended position during use may include mating a first component of an attachment means to a first component of a first shirt stay device and mating a second component of an attachment means to a second component of a second shirt stay device. The first shirt stay device and second shirt stay device may be adjusted to accommodate the user's height.

Figure 7:
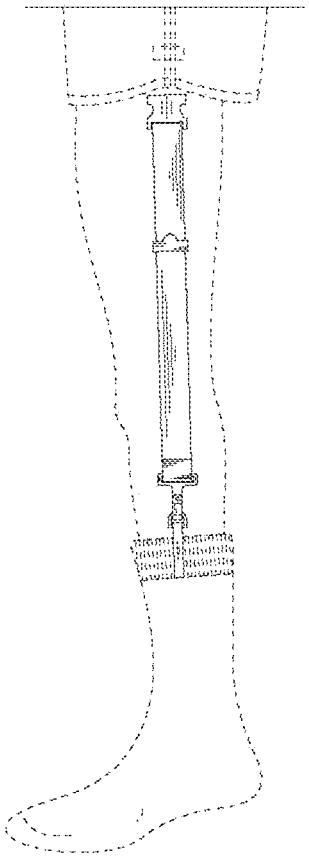
FIG. 7 illustrates an outer side view of the shirt stay system shown in FIG. 6.
Figure 8:
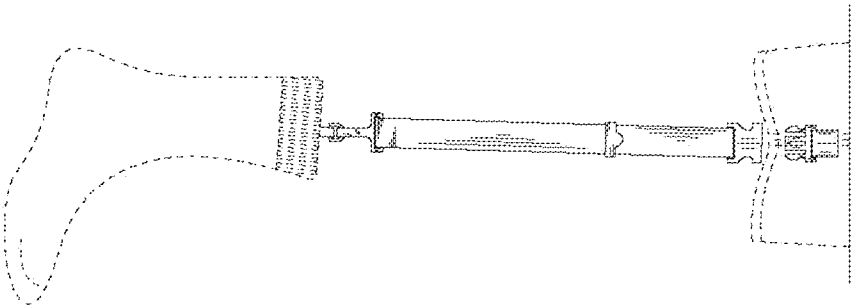
FIG. 8 illustrates an inner side view of the shirt stay system shown in FIG. 6.

A hook of the first shirt stay device may be attached to an attachment loop of a first sock component. A hook of the second shirt stay device may be attached to an attachment loop of a second sock component. FIGS. 7 and 8 illustrate exemplary outside and inside views, respectively, of the shirt stay device attached to the sock components but detached from the attachment means of the garment.

In a preferred embodiment, a shirt stay device includes: an elongated portion of material, a component of a side release buckle affixed to a proximal end of the elongated portion of material, and a hook affixed to a distal end of the elongated portion of material.

In a preferred embodiment, a garment includes: a component of a side release buckle affixed to a left hem on the garment, such as above a bottom edge of the left hem, and a component of a side release buckle affixed to a right hem on the garment, such as above a bottom edge of the right hem.

In a preferred embodiment, a pair of sock includes: a first sock component comprising an attachment means adjacent an edge of a top opening of the first sock component; and a second sock component comprising a second attachment means adjacent an edge of a top opening of the second sock component. The attachment means generally comprise a loop of material, D-ring, or O-ring.

In a preferred embodiment, a system for biasing a shirttail to a flat and fully extended position, e.g., securely tucked position in a wearer's pants, includes: a garment comprising a component of a side release buckle affixed to a left hem on the garment, and a component of a side release buckle affixed to a right hem on the garment; a first shirt stay device and a second shirt stay device, each comprising a component of a side release buckle affixed to a proximal end of an elongated portion of material, and a hook affixed to a distal end of the elongated portion of material; a first sock component and a second sock component, each comprising an attachment means configured for connection with the hook of the shirt stay device. The components of the side release buckle on each of the shirt and shirt stay device are mated, i.e., male and female.

All documents cited herein are incorporated herein by reference, but only to the extent that the incorporated material does not conflict with existing definitions, statements, or other documents set forth herein. To the extent that any meaning or definition of a term in this document conflicts with any meaning or definition of the same term in a document incorporated by reference, the meaning or definition assigned to that term in this document shall govern. The citation of any document is not to be construed as an admission that it is prior art with respect to this application.

While particular embodiments have been illustrated and described, it would be obvious to those skilled in the art that various other changes and modifications may be made without departing from the spirit and scope of the invention. Those skilled in the art will recognize or be able to ascertain using no more than routine experimentation, numerous equivalents to the specific apparatuses and methods described herein, including alternatives, variants, additions, deletions, modifications and substitutions. This application including the appended claims is therefore intended to cover all such changes and modifications that are within the scope of this application.

What is claimed is:

1. A system for biasing a shirttail to a flat and fully extended position, the system comprising:

a shirt comprising:

a first side release buckle component permanently affixed to a left hem of the shirt by a first loop of material stitched to the shirt such that the first side release buckle component is entirely above the bottom edge of the left hem, and a second side release buckle component permanently affixed to a right hem of the shirt by a second loop of material stitched to the shirt such that the second side release buckle component is entirely above the bottom edge of the right hem;

first and second shirt stay devices each comprising:

an elongated length of material having a first end and a second end, an adjustable suspender attached on the elongated length of material and configured to adjust a length of the first shirt stay device and the second shirt stay device respectively, a shirt stay side release buckle component affixed to the first end of the elongated length of material, and a hook affixed to the second end of the elongated length of material;

first and second socks each comprising an attachment loop affixed to a top opening thereof, wherein the shirt stay side release buckle component of each of the first and second shirt stay devices releasably attaches to the first and second side release buckle components of the shirt, respectively, and the hook of each of the first and second shirt stay devices releasably attaches to the attachment loop of the first and second socks, respectively, and wherein a length of each of the first and second shirt stay devices is adjustable to apply a tension between the left and right hems of the shirt and the first and second socks, respectively.

2. The system of claim 1, wherein the first and second side release buckle components of the shirt comprise a male component, and the shirt stay side release buckle components of each of the first and second shirt stay devices comprise a female component.

3. The system of claim 1, wherein the attachment loop affixed to the top opening of each of the first and second socks comprises a D-ring or O-ring attached to the top opening by a length of material.

4. The system of claim 3, wherein the length of material permanently affixed to the top opening of the sock non-releasably connects the D-ring or O-ring thereto.

5. The system of claim 1, wherein the attachment loop is a fabric loop.

6. The system of claim 1, wherein the first and second side release buckle components of the shirt are affixed to an internal or external side of the left and right hem of the shirt, respectively.

7. A shirt stay system comprising:

a shirt comprising a right-side connector permanently attached to a right hem of the shirt by a first loop of material stitched to the shirt such that the right-side connector is positioned entirely above a bottom edge of the right hem, and a left-side connector permanently attached to a left hem of the shirt by a second loop of material stitched to the shirt such that the left-side connector is positioned entirely above a bottom edge the left hem;

a pair of socks, each sock of the pair comprising an attachment loop attached to an outer side of a top opening thereof; and a set of two shirt stay devices each comprising:

an elongated length of material having a first end and a second end, a shirt connection component attached to the elongated length of material at the first end thereof and configured for releasable connection with either of the right-side or left-side connectors of the shirt, a hook attached to the elongated length of material at the second end thereof and configured for connection with the attachment loop of either sock of the pair of socks, and an adjustable suspender attached on the elongated length of material and configured to adjust a length of the shirt stay device, wherein the length of each of the shirt stay devices is adjustable to apply a tension between the left and right hems of the shirt and each sock of the pair of socks, respectively.

8. The system of claim 7, wherein each of the right-side and left-side connectors of the shirt comprise a female component of a side-release buckle, and the shirt connection component of each of the shirt stay devices comprises a male component of the side release buckle; or wherein each of the right-side and left-side connectors of the shirt comprise the male component of the side-release buckle, and the shirt connection component of each of the shirt stay devices comprises the female component of the side release buckle.

9. The system of claim 7, wherein the attachment loop of each sock comprises a D-ring or O-ring attached to the outer side of the top opening of the sock by a length of material.

10. The system of claim 9, wherein the length of material is permanently affixed to the top opening of the sock and releasably or non-releasably attaches the D-ring or O-ring thereto.

11. The system of claim 7, wherein the attachment loop is a fabric loop.

12. A method of using the shirt stay system of claim 7, the method comprising:

mating the shirt connection component of a first of the set of two shirt stay devices to either of the right-side or the left-side connector on the shirt, and mating the shirt connection component of a second of the set of two shirt stay devices to the other of the right-side or the left-side connector on the shirt;

connecting the hook of the first shirt stay device to the attachment loop of a first sock of the pair of socks, and connecting the hook of the second shirt stay device to the attachment loop of a second sock of the pair of socks; and adjusting the length of the first shirt stay device and the second shirt stay device to accommodate a user's height and to apply a tension between the shirt and the first and second socks, wherein the system maintains the shirt is a tucked position during use.

* * * * *